United States Patent [19]

Pulichino, Jr. et al.

[11] Patent Number: 4,753,342

[45] Date of Patent: Jun. 28, 1988

[54] GARMENT CARRIER

[75] Inventors: John V. Pulichino, Jr., Providence, R.I.; Robert DeFelice, Reading, Mass.

[73] Assignee: American Tourister, Inc., Warren, R.I.

[21] Appl. No.: 12,517

[22] Filed: Feb. 9, 1987

[51] Int. Cl.[4] ..... A45C 5/12; A45C 13/00; A40C 13/26; B65D 85/18

[52] U.S. Cl. ..... 206/291; 206/279; 206/292; 206/293; 206/287.1; 190/13 F; 190/109; 211/94.5; 248/316.1

[58] Field of Search ..... 206/279, 285, 287, 287.1, 206/289, 290, 291, 293; 190/13 R, 13 F, 109, 119; 211/94, 94.5, 124; 248/340, 316.1; 24/545, 564, 571, 37; 223/92

[56] References Cited

U.S. PATENT DOCUMENTS

| | | | |
|---|---|---|---|
| Re. 31,075 | 11/1982 | London et al. | 206/287 |
| 649,848 | 5/1900 | Koenig | 32/48 R |
| 1,132,530 | 3/1915 | Warren | 206/290 |
| 1,225,001 | 5/1917 | Bartlett | 190/13 F |
| 1,520,044 | 12/1924 | Wilt | 190/13 R |
| 1,668,358 | 5/1928 | DeLuca | 206/298 |
| 1,671,385 | 5/1928 | Strayer | 383/68 |
| 1,789,164 | 1/1931 | Victorsohn | 206/289 X |
| 1,835,632 | 12/1931 | Buhrke | 211/70.2 |
| 1,948,019 | 2/1934 | Ballentine | 206/287 |
| 1,954,607 | 4/1934 | Wheary et al. | 206/289 |
| 2,066,646 | 1/1937 | Ritter, Jr. | 190/119 X |
| 2,229,182 | 1/1941 | Meyers | 211/94.5 |
| 2,348,902 | 5/1944 | Hart | 248/316.1 X |
| 2,352,102 | 6/1944 | Johnston | 206/285 |
| 2,565,969 | 8/1951 | Judson | 206/278 X |
| 2,671,706 | 3/1954 | Greengold | 206/287 X |
| 2,793,742 | 5/1957 | Mintz | 206/213 |
| 2,797,779 | 7/1957 | Davis | 206/287.1 X |
| 2,893,545 | 7/1959 | Garfunkel | 206/279 |
| 2,918,997 | 12/1959 | Kotkins | 190/113 X |
| 3,175,658 | 3/1965 | Bierman | 190/110 |
| 3,273,678 | 9/1966 | Koret | 206/287 X |
| 3,473,713 | 10/1969 | Campbell | 206/287.1 X |
| 3,566,456 | 3/1971 | London | 206/279 |
| 4,363,388 | 12/1982 | London et al. | 206/287 X |
| 4,618,058 | 10/1986 | Gregg et al. | 206/291 |
| 4,640,414 | 2/1987 | Mobley et al. | 206/291 X |
| 4,662,513 | 5/1987 | King et al. | 206/287.1 |

FOREIGN PATENT DOCUMENTS

| | | | |
|---|---|---|---|
| 643888 | 7/1962 | Canada | 190/109 |
| 653589 | 12/1962 | Canada | 248/340 |
| 8603177 | 6/1986 | PCT Int'l Appl. | 206/287.1 |

*Primary Examiner*—William Price
*Assistant Examiner*—Sue A. Weaver

[57] ABSTRACT

A garment carrier includes an inner chamber. A stiff flap is hingedly mounted along a lower edge of the inner chamber between front and rear panels of the garment carrier. The flap includes a plurality of elastic shoe pockets for receiving shoes. A hanger bracket is pivotably mounted at an upper edge of the inner chamber. The hanger bracket includes a pair of spaced apart, stationary legs each of which having a resilient insert portion defining a longitudinal channel for receiving hanger hooks. Each of the insert portions includes longitudinally spaced projections extending perpendicularly into the channel. The projections on one side of the channel are aligned with, and terminate short of, the projections disposed on the opposite side of the channel. A pair of triangular corner pockets are positioned in two upper corners of the inner chamber. The corner pockets are formed of flexible material and provided with reinforcement to maintain their shape.

6 Claims, 4 Drawing Sheets

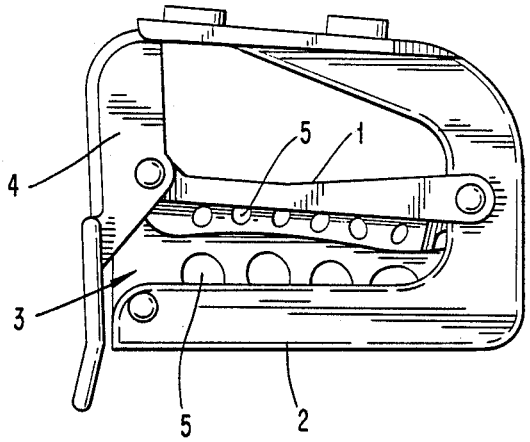
Fig. 8
PRIOR ART
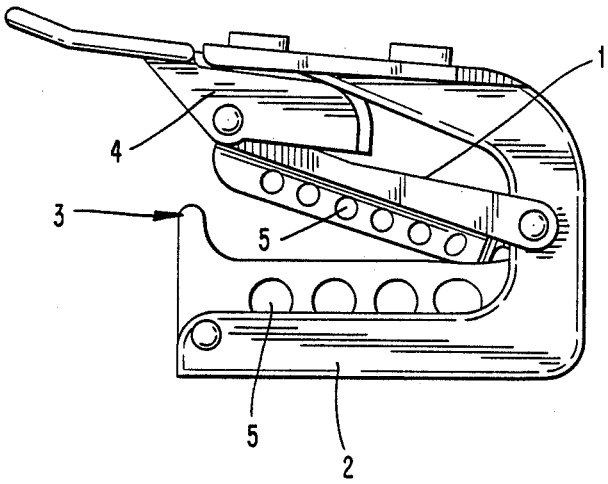
Fig. 9
PRIOR ART
Fig. 4A
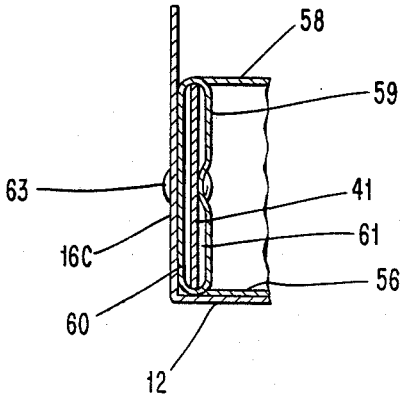

GARMENT CARRIER

BACKGROUND OF THE INVENTION

The present invention relates to luggage such as garment carriers and, in particular, to an arrangement of pockets and hanger retainers therein.

Garment carrier type luggage generally comprises front and rear panels interconnected by a side panel, with the rear panel being opened and closed by means of a zipper. It is conventional to attach a hanger clamp to a top wall of the hanger for receiving the hook portions of garment hangers. Hanger clamps are known which comprise a pair of vertically spaced legs which clamp hanger hooks therebetween by means of pivotal movement of one or both of the legs. For example, in London U.S. Pat. No. 4,363,388 a lower leg pivots upwardly against a stationary leg. A latch interconnects the front ends of the legs to secure the legs closed. Resilient inserts in the legs include smooth clamping surfaces which elastically grip the hanger hooks therebetween.

In another known clamp, depicted herein in FIGS. 8 and 9, a pivotable upper leg 1 of a housing pivots downwardly against a lower leg 2 of the housing to clamp a hanger bracket between smooth surfaces of an elastic insert 3 disposed in the legs. An actuator 4 for pivoting the upper leg 1 also functions as a latch for securing the pivotal leg 1 shut. Cylindrical holes 5 formed in the elastic insert 3 acts to reduce the hardness of the material of the insert 3 and allow greater clamping force.

In each of the above-described clamps there exists the possibility of the latch becoming accidentally opened, whereupon the hanger hooks could slide forwardly along the smooth elastic surfaces and become dislodged from the clamp. The garments on the hangers could then become severely wrinkled.

Applicants are aware of a proposal to provide a hanger bracket with a pair of spaced-apart stationary legs, with elastic inserts in the legs to form a hanger-receiving channel therebetween. The channel-defining surfaces of the inserts would contain pointed serrations on the elastic surfaces, with the serrations on one surface being offset, or staggered, relative to the serrations on the other surface in order to require a zig-zag pattern of movement for the hanger hooks, thereby resisting accidental dislodgement of the hooks. However, such an arrangement would also require a zig-zag pattern of movement for the hanger hooks when they are being inserted, whereby the loading of hangers into the hanger retainer becomes difficult and time-consuming.

One aspect of the present invention deals with the need to avoid accidental dislodgement of garment hangers.

It has been previously proposed to provide a garment carrier with elastic pockets for receiving shoes. The shoe pockets have been attached directly to the front and rear panel, whereby the garment carrier has been rendered more bulky. It would be desirable to eliminate such a disadvantage resulting from the provision of shoe pockets.

It is conventional to provide garment carriers with triangular pockets at the two upper corners of the internal chamber of the garment carrier (e.g., see U.S. Pat. No. 3,175,658). It would be desirable to enable such pockets to be formed of thin, non-resiliently flexible material such as fabric or plastic while maintaining a triangular pocket-like configuration.

SUMMARY OF THE INVENTION

In accordance with the present invention, a hanger bracket is provided for use in luggage to retain hanger hooks. The bracket comprises a housing of stiff material forming a pair of stationary spaced apart legs. Resilient inserts are disposed in the housing legs and include a pair of opposing surfaces forming therebetween a channel which is open at a front end and closed at a rear end. The channel is adapted to receive hanger hooks inserted into the front end of the channel. Each of the surfaces includes projections of substantially equal height extending into the channel to form pockets for receiving the hooks and resisting forward travel of the hooks. The projections on one of the surfaces are aligned with, and terminate short of, associated projections on the other surface. A latch is movably mounted on the housing adjacent the front end of the channel and is selectively movable to a closed position blocking the front end and an open position unblocking the front end.

Preferably, the distance between the aligned projections on opposite sides of the channel is slightly less than a diameter of a hanger hook to require a slight flexing of the projections in order to allow the hook to pass through.

In accordance with another aspect of the present invention, a garment carrier comprises a front panel, a rear panel, and a side panel interconnecting the front and rear panels. The panels define an internal chamber having a lower edge. A stiff flap is hingedly mounted adjacent a lower edge of the chamber between the front and rear panels. The flap includes a plurality of elastic shoe pockets for carrying shoes.

In accordance with a further aspect of the invention, a garment carrier comprises a front panel, a rear panel, and a side panel interconnecting front and rear panels. The panels define an internal chamber having two upper corners. A hanger retainer is provided for retaining garment hangers at an upper end of the chamber. The side panel includes a top portion and two upright portions extending from ends of the top portion. A stiffening panel is disposed within the internal chamber and extends along the top portion and along a part of the upright portions. Two corner pockets are disposed in respective upper corners. Each of the corner pockets is of generally triangular shape and comprises front and rear walls interconnected by a side wall. The front, rear, and side walls are formed of non-resiliently flexible material. A closure is provided for enabling the rear wall to be separated from the side wall along two sides of the triangular shape so that the rear wall can be swung open about the remaining side. Each corner pocket further comprises an outer wall of non-flexibly resilient material situated to the outside of the side wall to form therewith a channel extending along the two sides of the triangular shape which lie adjacent the top and upright portions, respectively. At least one end of the channel is open to receive the stiffening panel which extends within the channel along the last-named two sides of the triangular shape.

BRIEF DESCRIPTION OF THE DRAWINGS

The objects and advantages of the invention will become apparent from the following detailed description of a preferred embodiment thereof in connection with the accompanying drawings in which like numerals designate like element, and in which:

FIG. 4A is a cross-sectional view taken along the line 4A—4A in FIG. 4;

FIG. 8 is a side elevational view of a prior art clamp in a closed condition; and FIG. 9 is a view similar to FIG. 8 with the prior art clamp in an opened condition.

DETAILED DESCRIPTION OF A PREFERRED EMBODIMENT OF THE INVENTION

Figure 1:
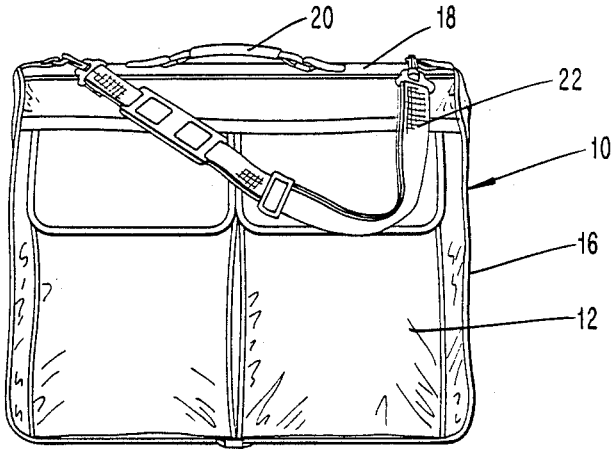
FIG. 1 is a front elevational view of a garment carrier according to the present invention, in a folded condition.
Figure 2:
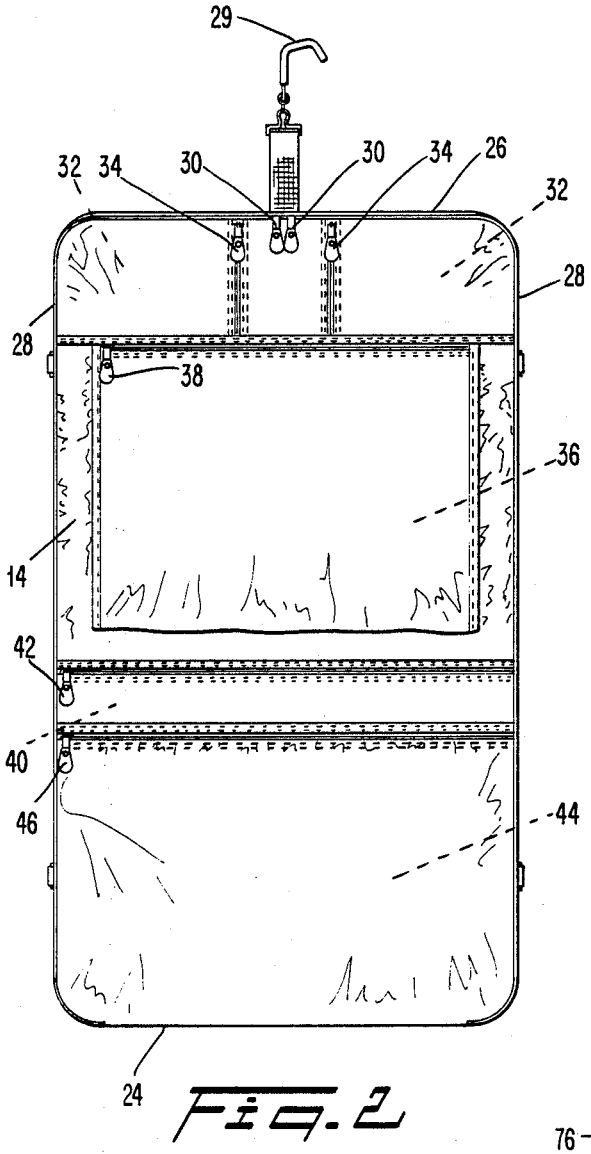
FIG. 2 is a rear elevational view of the garment carrier in an unfolded condition, with the rear panel in a closed condition.
Figure 3:
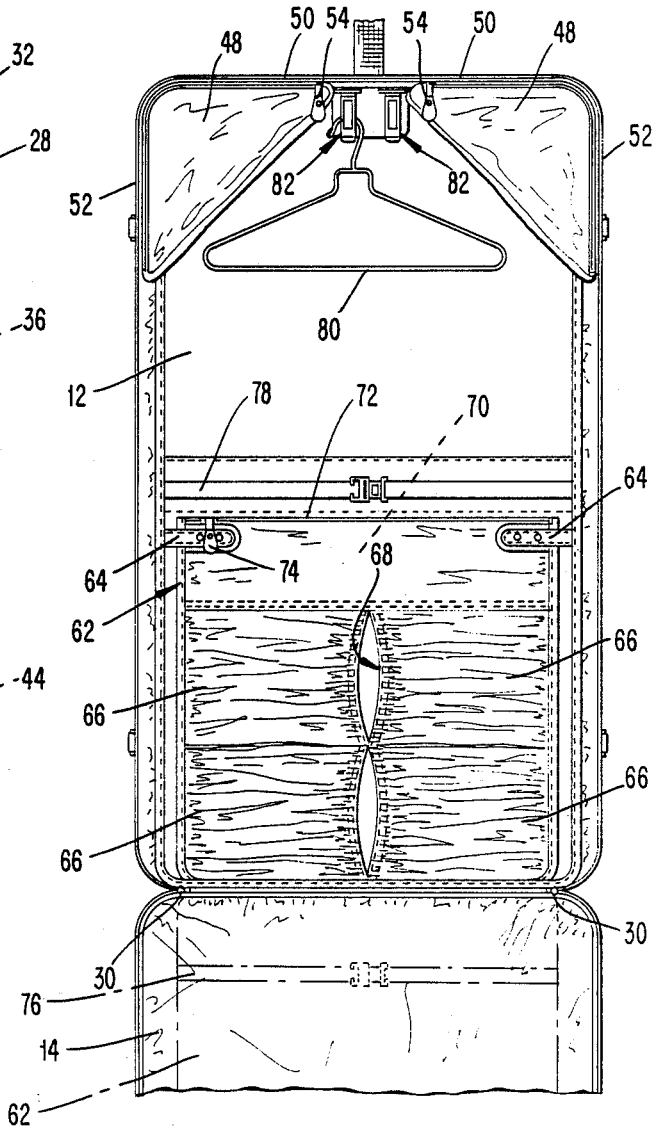
FIG. 3 is a view similar to FIG. 2 after the rear panel has been unzippered and hinged downwardly to expose the internal chamber.

Depicted in FIGS. 1 to 4 is a garment carrier 10 which comprises a front panel 12 (FIG. 1), a rear panel 14 (FIG. 2), and a side or edge panel 16 interconnecting the front and rear panels 12, 14. Those panels 12, 14, 16 define an internal chamber. Extending across the center of the front panel 12 is a strip 18 of relatively stiff material such as leather to which are attached a carrying handle 20 and carrying strap 22. The handle and strap permit the garment carrier to be carried in a folded condition (FIG. 1).

When the garment carrier is unfolded and viewed from the rear (FIG. 2) it is apparent that the entire rear area of the garment carrier is covered by the rear panel 14. The rear panel 14 is stitched (hinged) along its lower edge 24 to the side panel 16 and is removably attached along its top and side edges 26, 28 by means of twin zipper fasteners 30. A hook 29 is attached to an upper edge of the side panel 16 (FIG. 2) to enable the garment carrier to be suspended from a support (not shown).

The rear panel 14 includes a plurality of zippered compartments such as twin top compartments 32 which are closed by means of zippers 34, a center compartment 36 which is closed by a zipper 38, and a lower compartment 40 which is closed by a zipper 42. The lower compartment 40 carries a compartment 44 which is closed by a zipper 46.

Figure 4:
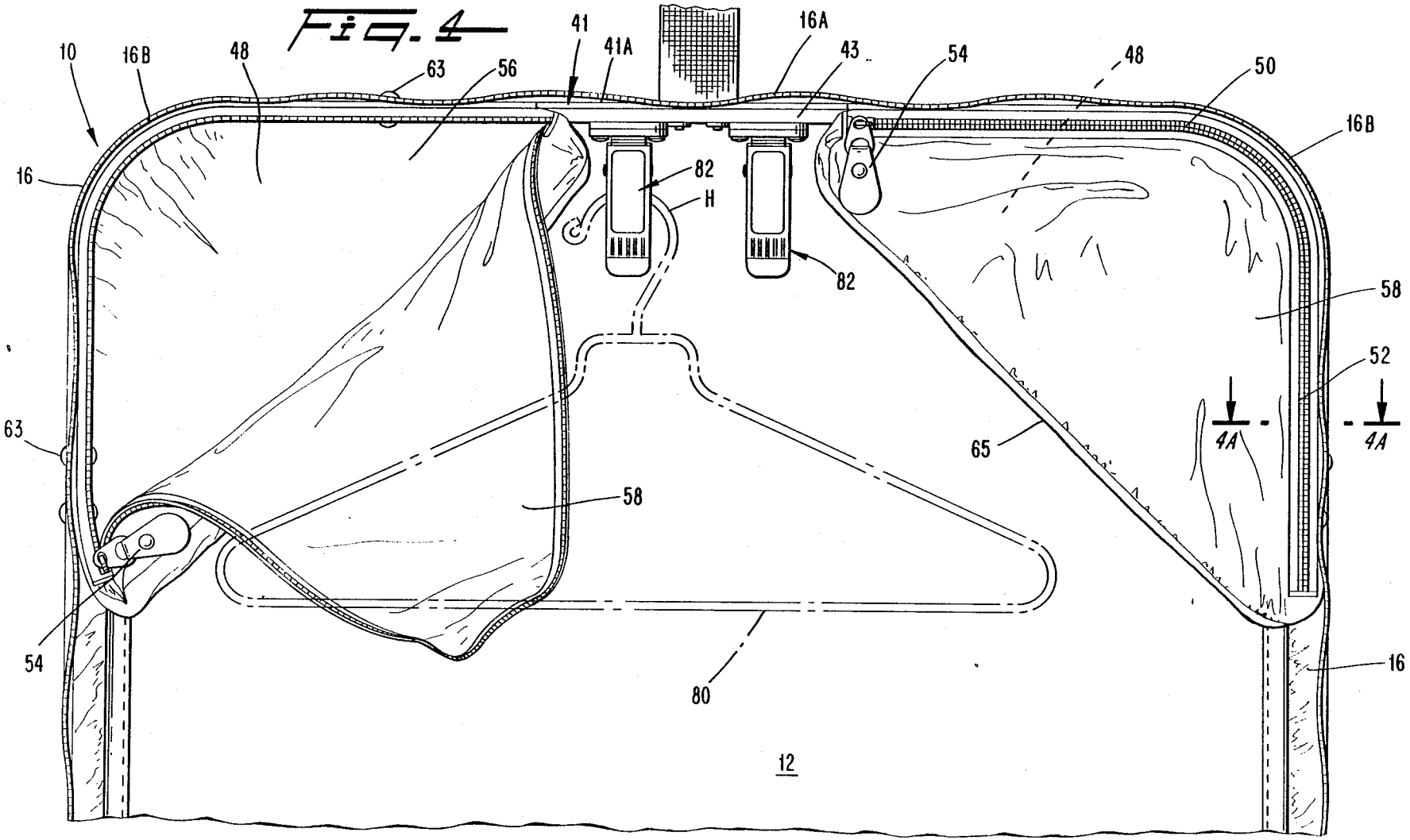
FIG. 4 is an enlarged view of an upper end of the internal chamber, with one of the corner pockets being opened.

Extending across an upper end of the side panel 16 within the internal chamber is a stiffening panel 41 (FIGS. 4, 4A ). That stiffening panel 41 includes a horizontal portion 41A extending along the top portion 16A of the side panel 16. The ends of the stiffening panel are bent and continue along the upper corners 16B of the side panel 16 and extend downwardly along a portion of the upright portions 16C of the side panel. A reinforcing panel 43, which is thicker and stiffer than the stiffening panel 41, is disposed beneath the top portion 41A of the reinforcing panel 41. The ends of the reinforcing panel 43 terminate short of the corners 16B.

Disposed in the upper corners 16B of the internal chamber of the garment bag are a pair of triangular corner pockets 48, each of which is closed along its upper and side edges 50, 52 by a zipper 54. Each pocket is formed by front and rear walls 56, 58 which are interconnected by a side wall 59 extending along all three sides of the pocket. Disposed along the exterior of the side wall 59 is an outer wall 60 which extends along only two sides of the side wall 60, i.e., the two sides which lie adjacent the top and upright portions 16A, 16B, 16C of the side panel 16. The outer wall 60 is stitched to front and rear edges of the side wall 59 so that a space or channel 61 is formed between the walls 59, 60 for the reception of the stiffening and reinforcing panels 41, 43. Thus, the upper end of the channel 61 is open to receive the stiffening and reinforcing panels 41, 43 and the lower end is stitched closed. Each bent end of the stiffening panel 41 extends along substantially the entire extent of the channel 61 and terminates adjacent the closed end thereof. The walls 59, 60, the side panel 16, and the stiffening panel 41 are secured together by suitable rivets 63. Similar rivets 63 are disposed along the top of the garment carrier to secure those same elements plus the reinforcing panel 43. Thus, the interior of each corner pocket 48 is bordered by the front and rear walls 56, 58 and the side wall 59, and the side wall 59 is stiffened by the stiffening panel 41 which extends along the entirety of the channel 61. This enables the walls 56, 58, 59 of the corner pocket to be formed of a thin, non-resiliently flexible (non-bulky) material such as fabric, plastic, etc., while maintaining its shape.

When the corner pocket is unzipped, it can be opened by swinging the rear wall 58 about the long edge 65 of the pocket. When the rear panel 14 of the garment carrier has been swung to a closed position (FIG. 2), the corner pockets 48 are covered and inaccessible. Access to those pockets 48 can then only be obtained by opening the rear panel 14.

Disposed at a lower end of the inner chamber is a flap 62 which is swingably (hingedly) mounted along a lower edge 24 of the garment carrier. The flap 62 is held in a retracted (upright) position by means of snap fasteners disposed on tabs 64 which are attached to the front panel 12.

Disposed on a rear side of the flap 62 are a plurality of elastically expandable shoe pockets 66, i.e., four shoe pockets 66 are depicted. Each of the shoe pockets 66 includes an elastic opening 68 which enables a shoe to be inserted horizontally therein. By positioning the shoe pockets on a flap which is separate from the front and rear panels, the shoes are disposed within the internal chamber in such fashion as to minimize externally visible bulges.

Along an upper portion of the flap 62 above the shoe pockets 66 is a compartment 70 which is closable along its upper edge 72 by a zipper 74.

On the front side of the flap 62 is provided a plurality of elastic straps 76 (one of which depicted by broken lines in FIG. 3), each of which can be buckled shut. A similar elastic strap 78 is connected to the front panel 12 above the flap 62. In the event that a long garment, such as a trench coat, is hung on a hanger 80 and extends beyond the lower edge 24 of the garment carrier, the flap 62 can be swung downwardly (as depicted in broken lines in FIG. 3) to enable the lower portion of the garment to be secured by the elastic strap(s) 76. Thereafter, the flap 62 is swung upwardly and secured by the snap fastener tabs 64.

Figure 5:
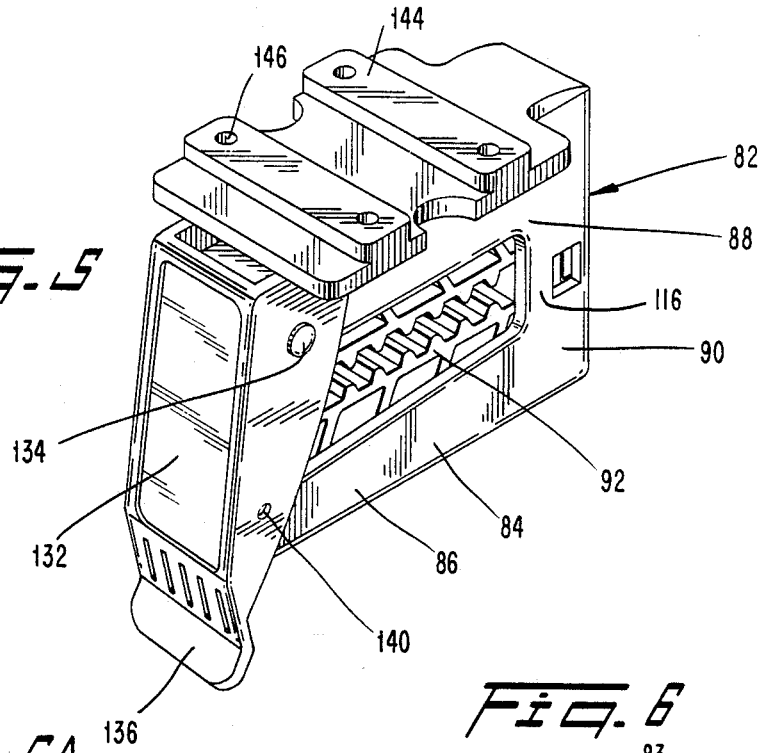
FIG. 5 is a top front perspective view of a hanger bracket according to the present invention.
Figure 6A:
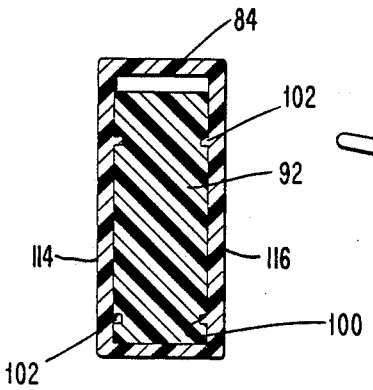
FIG. 6A is a cross-sectional view taken along the line 6A—6A in FIG. 6.
Figure 6:
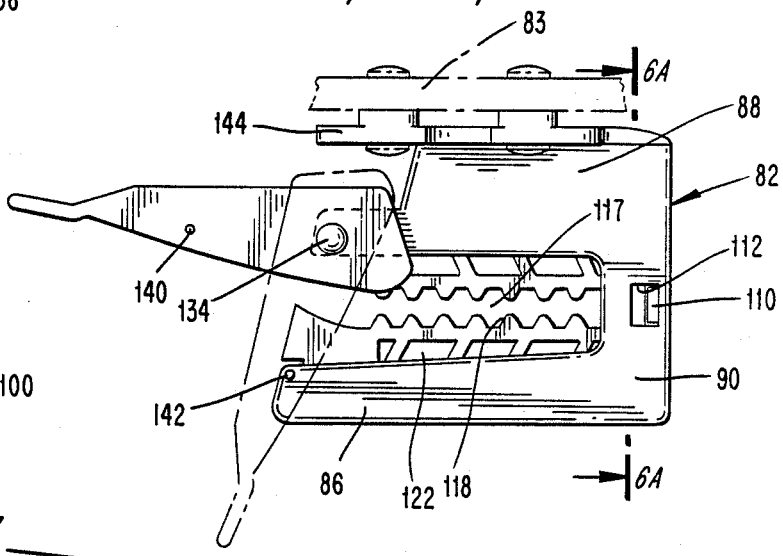
FIG. 6 is a side elevational view of the hanger bracket, with a latch thereof shown in open condition in solid lines and in a closed condition in broken lines.

The hanger 80 is secured in one of a pair of brackets 82. The brackets are riveted to a reinforcing plate 83 disposed to the inside of the side panel 16 along the upper edge of the garment carrier. A bracket 82, depicted more clearly in FIGS. 5 to 7, includes a housing 84. The housing 84 is U-shaped, comprising long and short legs 86, 88, respectively, interconnected by a bight 90. The housing 84 is hollow and open at its rear, i.e., open at the bight 90 to accommodate the reception of an insert 92.

Figure 7:
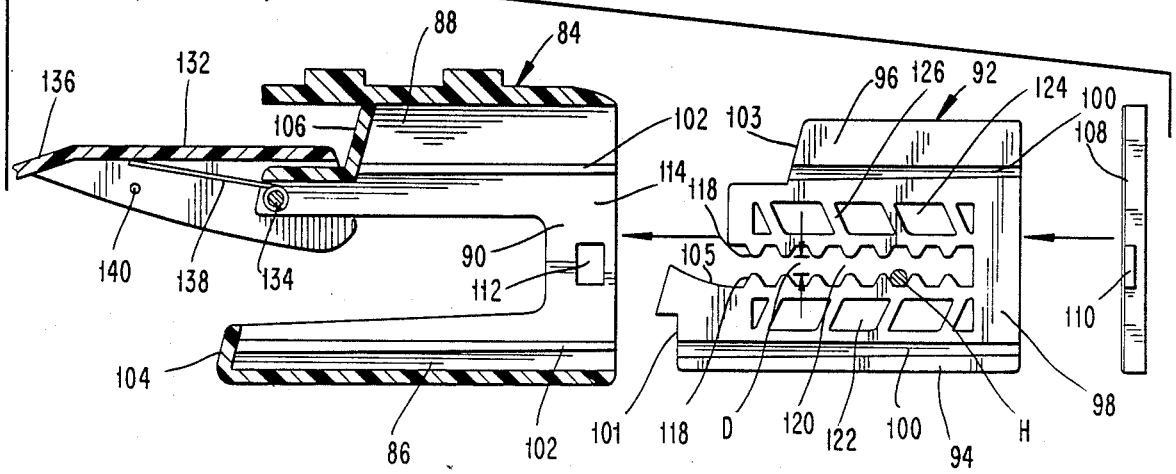
FIG. 7 is a side elevational, exploded view of the garment hanger, with the housing portion thereof depicted in longitudinal section.

The insert 92 is also U-shaped, including long and short legs 94, 96 interconnected by a bight 98. Each of the legs 94, 96 includes longitudinal tracks 100 at opposite sides which are adapted to receive longitudinal ribs 102 of the housing 84 when the insert is slid longitudinally forwardly into the housing 84 as depicted in FIG. 7. Travel of the insert within the housing is terminated when front ends 101, 103 of the long and short legs 94, 96 of the insert abut stop walls 104, 106 disposed at front ends of the long and short legs 86, 88, respectively, of the housing 84. The long or lower leg 94 of the insert terminates forwardly in an upwardly curving surface 105.

After the insert 92 has been installed, a back plate 108 is fitted into the rear end of the bight 90 of the housing. A pair of tabs 110 are provided on the sides of the back plate 108 which are received in recesses 112 formed in the bight 90 of the housing. A front portion of each tab is beveled to facilitate entry of the tabs 110 into the recesses 112. That is, the tabs cause the opposite walls 114, 116 of the bight 90 to slightly spread apart until the tabs are fully aligned with the recesses, whereupon the walls 114, 116 snap back to capture the tabs.

The housing 84 is formed of a stiff material such as a stiff plastic, and the insert is formed of an elastically flexible material such as rubber or a flexible plastic. The insert is compressed by the back plate 108 and thus reacts rearwardly against the back plate to press the tabs 110 against rear edges of the recesses 112.

The long and short legs 94, 96 are spaced apart to form therebetween a channel 117 adapted to receive the hooks of garment hangers, which are inserted from the front of the channel. The channel-forming surfaces of the long and short legs 94, 96 include projections 118 extending perpendicularly toward the channel to form pockets. The projections 118 of each leg are of equal height and are spaced apart longitudinally. The projections of one leg are aligned with, and terminate short of, oppositely associated projections of the other leg. Thus, the aligned projections 118 define a longitudinal passage therebetween to enable a hanger hook H to be pushed longitudinally into, or pulled longitudinally from, the passage in a straight (non zig-zag) direction. On the other hand, the projections will resist inadvertent travel of the hangers toward the front end of the channel in the event of accidental opening of the latch.

Preferably, the hanger hooks which are employed have a diameter slightly larger than the height of the passage (i.e., larger than the distance D between the opposing aligned projections 118), whereby the projections must flex apart slightly to permit longitudinal passage of the hanger hooks. Accordingly, unintentional longitudinal movement of the hanger hooks is rendered even more difficult.

In order to render the insert legs sufficiently flexible, the legs 94, 96 are provided with openings 122, 124 adjacent the channel-defining surfaces thereof. Stiffening braces 126 extend across the openings such that an end of each brace located farthest from the channel 117 is situated forwardly relative to the end located adjacent the channel, in order to facilitate deformation of the channel-forming surfaces in a direction away from the channel, i.e., the braces tend to pivot about their forward ends, rather than having to be compressed as would be necessary if the braces were to extend perpendicularly to the channel.

A latch 132 is pivotably mounted at a front end of the housing for closing-off the channel 117. The latch 132 is pivotably mounted at 134 to the short leg 88 such that the free end 136 of the latch swings upwardly to open the channel, and downwardly to block the channel. A torsion spring 138 biases the latch to the open position. A pair of bumps 140 formed on the latch are adapted to enter corresponding depressions 142 of the long leg 86 when the latch is in a closed position, in order to yieldably resist opening of the latch.

A pair of ears 144 are formed integrally on the top of the housing and include holes 146 to facilitate mounting of the bracket 82 onto the plate 83. The housing 84 and insert 92 are each of one-piece molded construction.

It will be appreciated that in accordance with the present invention a hanger bracket having aligned projections enables hangers to be easily inserted therein and removed therefrom, while resisting unintentional egress of the hanger from the bracket. Furthermore, by providing shoe pockets on a separate, swinging flap, the shoes are kept generally centered within the internal chamber, thereby reducing the overall bulkiness of the garment carrier. The corner pockets 48 are constructed of a thin, flexible (non-bulky) material due to the provision of the channels 61 which receive the stiffening panels 41.

Although the present invention has been described in connection with a preferred embodiment thereof, it will be appreciated by those skilled in the art that additions, modifications, substitutions and deletions not specifically described, may be made, without departing from the spirit and scope of the invention as defined in the appended claims.

What we claim is:

1. A hanger bracket for use in luggage to retain hanger hooks, said bracket comprising:

a hollow, generally U-shaped housing of stiff material forming a pair of stationary spaced apart legs, said legs being connected by a bight portion and said housing having an open rear portion:

a generally U-shaped insert, made from a resilient material, inserted into said hollow housing through said open rear portion and disposed in said housing legs and including a pair of opposing surfaces forming therebetween a channel open at a front end and closed at a rear end, said channel adapted to receive hanger hooks inserted into said front end of said channel, said surfaces each including projections of substantially equal height extending into said channel to form pockets for receiving said hooks and resisting forward travel of said hooks, said projections on one of said surfaces being aligned with, and terminating short of, associated projections on said other surface, the distance between the aligned projections on opposite sides of said channel being slightly less than the diameter of said hanger hook. whereby said projections must flex slightly to permit passage of said hanger hook;

means to block said rear portion after insertion of said insert and prevent the removal of said insert; and latch means movably mounted on said housing adjacent said front end of said channel and selectively movable between a closed position blocking said front end and an open position unblocking said front end.

2. A garment carrier comprising a front panel, a rear panel, and a side panel interconnecting said front and rear panels, said panels defining an internal chamber having a lower edge, a hanger retaining means secured at a top edge of said chamber, and a stiff flap hingedly mounted adjacent a lower edge of said chamber between said front and rear panels, said flap including a plurality of elastic shoe pockets for carrying shoes, said shoe pockets being disposed on a first side of said flap facing toward said rear panel when said flap is disposed within said chamber, a side of said flap opposite said first side including elastic bands for securing a lower portion of a garment hanging from hangers on said retaining means.

3. A garment carrier according to claim 2 wherein said hanger retaining means includes a hanger bracket to retain hanger hooks, said bracket comprising a housing formed of stiff material forming a pair of stationary spaced apart legs, resilient means disposed in said housing within both of said legs and including a pair of opposing surfaces forming therebetween a channel open at a front end and closed at a rear end, said channel adapted to receive hanger hooks inserted into said front end of said channel, said surfaces each including projections of substantially equal height extending into said channel to form pockets for receiving said hooks and resisting forward travel of said hooks, said projections on one of said surfaces being aligned with and terminating short of associated projections on said other surface, and latch means movably mounted on said housing adjacent said front end of said channel and selectively movable between a closed position blocking said front end and an open position unblocking said front end.

4. A garment carrier according to claim 2 wherein said connected front, rear and side panels also define two upper corners in said internal chamber and which further includes; two corner pockets disposed in respective ones of said upper corners, each of said corner pockets being of a generally triangular shape and comprising front, rear, and side walls formed of non-resiliently flexible material and closure means connected to said rear wall and side wall for enabling said rear wall to be separated from said side wall along two sides of said triangular shape so that said rear wall can be swung open about the remaining side.

5. A garment carrier according to claim 4 wherein said side panel includes a top portion and two upright portions extending from ends of said top portion and further including; a stiffening panel disposed within said internal chamber along said top portion and along a part of said upright portions and each corner pocket further comprises an outer wall of non-flexible resilient material situated to the outside of said side wall to form therewith a channel extending along the two sides of said triangular shape which lie adjacent said top and upright portions, respectively, at least one end of said channel being open to receive said stiffening panel which extends within said channel along said last-named two sides of said triangular shape.

6. A garment carrier comprising:

(a) a front panel;

(b) a rear panel;

(c) a side panel interconnecting said front and rear panels, said panels defining an internal chamber having a lower edge, an upper edge, and two upper corners;

(d) a hanger bracket to retain hanger hooks, said bracket mounted at said upper edge of said chamber and comprising a housing formed of stiff material forming a pair of stationary spaced apart legs, resilient means disposed in said housing within both of said legs and including a pair of opposing surfaces forming therebetween a channel open at a front end and closed at a rear end, said channel adapted to receive hanger hooks inserted into said front end of said channel, said surfaces each including projections of substantially equal height extending into said channel to form pockets for receiving said hooks and resisting forward travel of said hooks, said projections on one of said surfaces being aligned with and terminating short of associated projections on said other surface, and latch means movably mounted on said housing adjacent said front end of said channel and selectively movable between a closed position blocking said front end and an open position unblocking said front end; and (e) a stiff flap hingedly mounted adjacent said lower edge of said chamber between said front and rear panels, said flap including a plurality of elastic shoe pockets for carrying shoes, said shoe pockets being disposed on a first side of said flap facing toward said rear panel when said flap is disposed within said chamber, a side of said flap opposite said first side including elastic bands for securing a lower portion of a garment hanging from hangers on said hanger bracket; and (f) two corner pockets disposed in respective ones of said upper corners, each of said corner pockets being of a generally triangular shape and comprising front, rear and side walls formed of non-resiliently flexible material and having closure means connected to said rear wall and side wall for enabling said rear wall to be separated from said side wall along two sides of said triangular shape so that said rear wall can be swung open about the remaining side.

* * * * *